US005891824A

United States Patent [19]

Simpson et al.

[11] Patent Number: 5,891,824

[45] Date of Patent: Apr. 6, 1999

[54] TRANSPARENT PROTECTIVE SHEET FOR THERMAL DYE TRANSFER PRINT

[75] Inventors: William H. Simpson, Pittsford; John E. Benson, Webster; Mary-Irene E. Condo, Rochester, all of N.Y.

[73] Assignee: Eastman Kodak Company, Rochester, N.Y.

[21] Appl. No.: 767,757

[22] Filed: Dec. 17, 1996

[51] Int. Cl.[6] ..... B41M 5/035; B41M 5/38

[52] U.S. Cl. ..... 503/227; 156/235; 428/203; 428/204; 428/480; 428/913; 428/914

[58] Field of Search ..... 427/152; 503/227; 428/195, 204, 913, 914, 203, 480; 156/235

[56] References Cited

U.S. PATENT DOCUMENTS

| | | | |
|---|---|---|---|
| 4,505,975 | 3/1985 | Majima et al. | 428/336 |
| 5,250,133 | 10/1993 | Kawamura et al. | 156/240 |
| 5,427,997 | 6/1995 | Oshima et al. | 503/227 |

*Primary Examiner*—Bruce H. Hess
*Attorney, Agent, or Firm*—Harold E. Cole

[57] ABSTRACT

A dye-receiver element comprising a support having thereon a dye-receiving layer containing a thermally-transferred dye image, the dye-receiving layer having on top thereof a transparent protective sheet comprising a polyester resin containing an ultraviolet absorbing agent.

14 Claims, No Drawings

TRANSPARENT PROTECTIVE SHEET FOR THERMAL DYE TRANSFER PRINT

This invention relates to a thermal dye transfer receiving element which has a transparent protective sheet located on the top thereof.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. Also, dye fading may occur from fingerprint marking because the image dyes are located at the surface. These dyes can be driven further into the dye-receiving layer by thermally fusing the print with either hot rollers or a thermal head. This will help to reduce dye retransfer and fingerprint susceptibility, but does not eliminate these problems. However, the application of a protective overcoat will practically eliminate these problems.

The degree of dye fading in a printed image is dependent upon the wavelengths of light absorbed by the dye. A yellow dye will absorb blue light and some ultraviolet light in the region 290–400 nm, depending upon its structure. Magenta and cyan dyes absorb green and red light as well as ultraviolet (UV) light. The colors of an image can be observed due to the reflection of some wavelengths of visible light and the absorption of others between 400 and 700 nm where the human eye is sensitive. It is because of this that visible light cannot be screened from the image dyes to prevent fading by light exposure.

UV light (that portion of the spectrum below 400 nm) does not play a role in the color of an image unless the dyes fluoresce and the fluorescence adds to the quality of the hue. Therefore UV light can be screened from the image dyes by absorbing it with an overlay. UV light also is of high energy and adds significantly to the degradation of any dyes which absorb it.

Co-pending U.S. patent application 08/688,975 of Reiter et al. relates to a composite thermal dye transfer ID card stock. There is a disclosure in this application that a clear, protective sheet may be applied to the card using a laminator with heat and pressure. However, no specific materials for the protective sheet are mentioned.

JP 08/039946 relates to the use of an adhesive which contains a material which absorbs UV light between 290 and 400 nm as an overlay or overlaminate for a thermal print to protect the dyes in photographic images and thermal prints from fade in sunlight or fluorescent light.

However, there is a problem with locating a UV-absorber in an adhesive. Care must be taken to select an adhesive which does not sensitize the image dyes to fade. Since the UV-absorber is usually dissolved in the adhesive, the selection of the polymer binder becomes more critical. The adhesive must also function to bind the overlaminate to the print and act as a solvent for the UV-absorber as well.

A UV-absorbing material added to an adhesive layer protects the dyes in the region 300–400 nm where the polyester support does not absorb light. The degree of protection offered by the UV-absorber is directly related to its coefficient of absorptivity ($\epsilon$) and its concentration in the adhesive layer.

A disadvantage of adding a UV-absorber to a coated layer is the possibility of poor keeping of the material because of the formation of a second phase which scatters light resulting in a hazy appearance. Still another disadvantage is that the UV-absorber may be incompatible with an image dye because of an adverse chemical reaction between the two which results in degradation of the dye in a dark environment. Yet still another disadvantage in coating a UV-absorber as a separate layer on the polyester substrate is that it must be soluble in the coating solvent or capable of being dispersed as solid where the particles are small enough in diameter so that light is not scattered. The latter criteria preclude the use of some insoluble UV-absorbers which are colorless and have a high $\epsilon$ value.

It is an object of this invention to provide a transparent protective sheet for a thermal dye transfer image which exhibits superior adhesiveness and resistance to delamination and abrasion, as well as chemical stability on contact with commonly encountered solvents. It is another object to provide a protective laminate for a thermal dye transfer image wherein image stability and integrity are enhanced.

These and other objects are achieved in accordance with this invention which relates to a dye-receiver element comprising a support having thereon a dye-receiving layer containing a thermally-transferred dye image, the dye-receiving layer having on top thereof a transparent protective sheet comprising a polyester resin containing an ultraviolet absorbing agent.

In a preferred embodiment of the invention, the transparent protective sheet is laminated to the receiving element by means of an adhesive. In another preferred embodiment, the polyester sheet is biaxially-oriented.

Another embodiment of the invention relates to a process of laminating a transparent protective sheet on top of a thermal dye transfer image comprising:

(I) imagewise-heating a dye-donor element comprising a support having thereon a dye layer comprising an image dye in a binder, the dye-donor being in contact with a dye-receiving element, thereby transferring a dye image to the dye-receiving element to form the dye transfer image; and (II) thermally laminating the transparent protective sheet on top of said transferred dye image by means of an adhesive;

the transparent protective sheet comprising a polyester sheet containing an ultraviolet absorbing agent.

Usually, the ultraviolet-absorbing agent is incorporated after polymerization of the polyester resin by melt compounding the ultraviolet-absorbing agent into the resin. Another way to incorporate the ultraviolet-absorbing agent into the polyester is to polymerize the ultraviolet-absorbing agent into the backbone of the polyester resin, as disclosed in U.S. Pat. No. 5,480,926, the disclosure of which is hereby incorporated by reference.

In the embodiment of the invention using an adhesive, any adhesive may be used provided it produces the desired results. For example, there may be employed adhesives such as a polyester ionomer, e.g., Bostik® 7963 (Bostik Co), or phenoxy resins such as Paphen® resins such as Phenoxy Resins PKHC®, PKHH® and PKHJ® (Phenoxy Associates); and 045A and 045B resins (Scientific Polymer Products) which have a mean number molecular weight of greater than about 10,000.

In a preferred embodiment of the invention, the adhesive employed is a phenoxy resin such as Phenoxy Resin PKHC®, PKHH® or PKHJ® having the following formula:

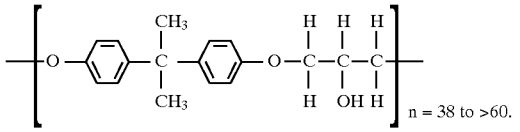

When an adhesive such as a phenoxy resin is employed in the invention, it may be used in an amount of at least about 0.5 g/m$^2$ as coated on the protective sheet.

The transparent protective sheet employed in the invention may be a polyester such as poly(ethylene terephthalate), poly(ethylene naphthalate), and their copolyesters; polycarbonates, poly(vinyl chloride), polyolefins, polystyrene, acrylics, fluoropolymers, poly(vinylidene chloride), cellulosics, nylons, etc.

The protective sheet may be coated with a subbing layer such as a titanium alkoxide, if desired. The thickness of the transparent protective sheet may be, for example, from about 2 $\mu$m to about 250 $\mu$m.

The present invention provides a protective overcoat sheet applied to a thermal print by uniform application of heat using a laminator such as Kodak Readyprint Photo Laminator (Eastman Kodak Co., Rochester, N.Y.), or any device capable of providing heat and pressure.

By use of the invention, the laminated protective sheet provides superior protection of the thermal image against image deterioration due to exposure to light, common chemicals, such as grease and oil from fingerprints, and plasticizers from film album pages or sleeves made of poly(vinyl chloride).

The UV-absorber used in the invention or in protective sheets for photographic prints or other imaged materials, should be colorless and have a high coefficient of absorptivity ($\epsilon$) in the region between 290 and 400 nm. The material should be soluble in the coating solvent and free from crystallization or phase separation from the binder when the coating solvent is evaporated.

In a preferred embodiment, the UV-absorbing agents used in the invention may be, for example, a benzoxazinone such as Cyasorb® UV3638 (Cytec Industries) having the structure:

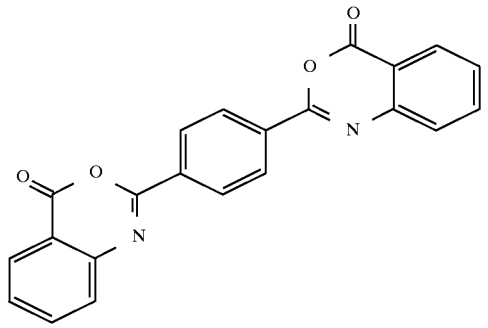

Cyasorb ® UV 3638 or benzophenones, benzotriazoles, oxalanilides, benzoates, hindered amine light stabilizers, nickel containing light stabilizers such as nickel dibutyldithiocarbamate, or complexes containing Ba, Na, Zn or P; or any material with a $\epsilon$ greater than 20 L/g-cm at a peak wavelength between 290 and 400 nm which is stable during heat transfer.

The UV-absorbing material which is incorporated into a sheet of polyester in accordance with the invention may be used at a level of about 0.01 to about 5.0 wt-%, preferably between about 0.5 and 1 wt-%. This will enhance the ability of the polyester sheet to absorb incident radiation between 290 and 400 nm. The absorption of radiation in this spectral region improves the light fade of dyes when the polyester sheet is used as an overlay or overlaminate of an image.

The Cyasorb® UV3638, described above, is a white solid with an $\epsilon$ of 124 L/g-cm in dichloromethane at 349 nm. The color and very high coefficient of absorptivity make it an attractive material for use as a UV screening agent in coated layers. While it is highly soluble only in hot dimethylformamide which makes it impractical for coating, it is soluble in molten polyester which forms a clear and colorless film when drawn and tendered.

A polyester sheet which contains UV3638 can be prepared by dissolving UV3638 in a polyester melt and extruding the polyester into a sheet or roll which is then oriented if desired. The sheet or film can be placed over the receiver without lamination to absorb incident ultraviolet light or it can be coated with an adhesive and laminated to the print. Placing the UV-absorber into the polyester solves the problem of its insolubility in coating solvents and allows one to take advantage of its colorless nature and high coefficient of absorptivity. Yellow, magenta and cyan dyes can be thermally transferred from a dye-donor element to form a multicolor image on the dye-receiving sheet. Any dye can be used in the dye layer of the dye-donor element used in the invention provided it is transferable to the dye-receiving layer by the action of heat. Examples of such dyes include

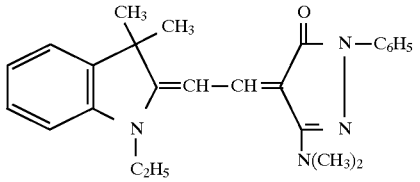

Yellow Dye 1

-continued

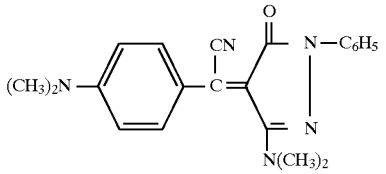

Magenta Dye 2

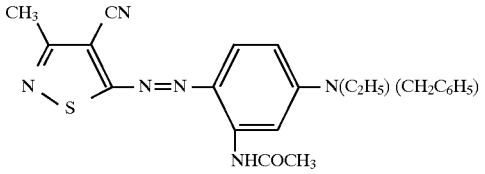

Magenta Dye 3

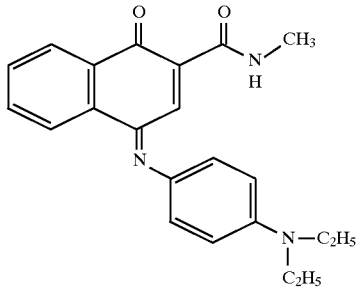

Cyan Dye 4

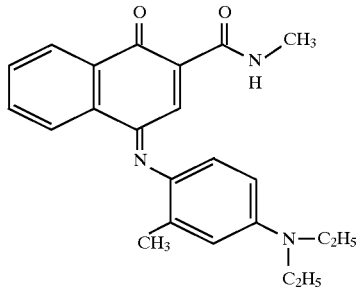

Cyan Dye 5

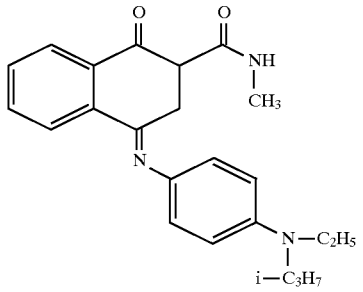

Cyan Dye 6 or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The support for the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper, a synthetic paper such as DuPont Tyvek®, or a laminated, microvoided, composite packaging film support as described in U.S. Pat. No. 5,244,861.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

The following examples are provided to illustrate the invention.

EXAMPLE

A. Dye-Donor Element

A dye-donor element was prepared by coating on a 6 $\mu$m poly(ethylene terephthalate) support:

1) a subbing layer of titanium tetrabutoxide (DuPont Tyzor TBT)® (0.12 g/m$^2$) from a n-propyl acetate and n-butyl alcohol solvent mixture, and 2) repeating yellow, magenta and cyan dye patches containing the compositions as described below.

On the back side of the element were coated the following layers in sequence:

1) a subbing layer of titanium tetrabutoxide (DuPont Tyzor TBT)® (0.12 g/m$^2$) from a n-propyl acetate and n-butyl alcohol solvent mixture, and 2) a slipping layer containing an aminopropyldimethyl-terminated polydimethylsiloxane, PS-513® (United Chemical Technologies, Bristol, Pa.)(0.01 g/m$^2$), a poly(vinyl acetal) binder (0.38 g/m$^2$) (KS-1, Sekisui Chemical Co.), p-toluenesulfonic acid (0.0003 g/m$^2$), and candelilla wax (0.02 g/m$^2$), coated from diethyl ketone.

The yellow composition contained 0.27 g/m$^2$ of the Yellow Dye 1 illustrated above, 0.07 g/m$^2$ of CAP 482-0.5 (cellulose acetate propionate) 0.5 s viscosity (Eastman Chemical Co.), 0.287 g/m$^2$ of CAP 482-20 (cellulose acetate propionate) 20 s viscosity (Eastman Chemical Co.), 0.002 g/m$^2$ of Fluorad FC-430® fluorocarbon surfactant (3M Corp.) in a solvent mixture of toluene, methanol and cyclopentanone (66.5/28.5/5).

The magenta composition contained 0.18 g/m$^2$ of the Magenta Dye 2 illustrated above, 0.17 g/m$^2$ of Magenta Dye 3 illustrated above, 0.17 g/m$^2$ of CAP 482-0.5, 0.31 g/m$^2$ of CAP 482-20,0.07 g/m$^2$ of 2,4,6-trimethylanilide of phenylindane-diacid, 0.002 g/m$^2$ of Fluorad FC-430® in a solvent mixture of toluene, methanol and cyclopentanone (66.5/28.5/5).

The cyan composition contained Cyan Dye 4 at 0.127 g/m$^2$, Cyan Dye 5 at 0.115 g/m$^2$, Cyan Dye 6 at 0.275 g/m$^2$, 0.30 g/m$^2$ of CAP 482-20, and Fluorad FC-430® (0.002 g/m$^2$) in a solvent mixture of toluene, methanol and cyclopentanone (66.5/28.5/5).

B. Receiver Element A:

Receiver element A consisted of four layers coated on 195 $\mu$m poly(ethylene terephthalate) support, Estar® (Eastman Kodak Co.).

The first layer, coated directly on the support, consisted of a copolymer of butyl acrylate and acrylic acid (50/50 wt. %) at 8.07 g/m$^2$, 1,4-butanediol diglycidyl ether (Eastman Kodak Co.) at 0.57 g/m$^2$, tributylamine at 0.32 g/m$^2$, and Fluorad® FC-431 surfactant (3M Corp.) at 0.016 g/m$^2$.

The second layer consisted of a copolymer of 14 mole-% acrylonitrile, 79 mole-% vinylidine chloride, and 7 mole-% acrylic acid at 0.54 g/m$^2$, and DC-1248 silicone fluid (Dow Corning) at 0.016 g/m$^2$.

The third layer consisted of Makrolon® KL3-1013 polycarbonate (Bayer AG) (1.78 g/m$^2$) and Lexan® 141-112 polycarbonate (General Electric Co.) (1.44 g/m$^2$), dibutyl phthalate (Eastman Kodak Co.) (0.32 g/m$^2$), diphenyl phthalate (Eastman Kodak Co.) (0.32 g/m$^2$), and Fluorad® FC-431 (0.012 g/m$^2$).

The fourth, topmost layer, of the element consisted of a copolymer of 50 mole-% bisphenol A, 49 mole-% diethylene glycol and 1 mole-% of a polydimethylsiloxane block (0.65 g/m$^2$), Fluorad® FC-431 (0.054 g/m$^2$), and DC-510 (Dow Coming Co.) (0.054 g/m$^2$).

Thermal Dye Receiver B:

Receiver Element B consisted of a base material as described in U.S. Pat. No. 5,244,861 subbed with Prosil® 2210 (an aminofunctional epoxysilane, PCR CO.). A receiving layer is coated directly onto the subbing layer consisting of Makrolon® KL3-1013 polycarbonate (Bayer AG) at 1.775 g/m$^2$, Lexan® 141-112 polycarbonate (GE) at 1.453 g/m$^2$, Fluorad® FC-431 at 0.011 g/m$^2$, dibutyl phthalate at 0.323 g/m$^2$, and diphenyl phthalate at 0.323 g/m$^2$. The receiver layer was then overcoated with a polymeric layer consisting of a copolymer of 50 mole-% bisphenol A, 49 mole-% diethylene glycol and 1 mole-% of a polydimethylsiloxane block at a laydown of 0.646 g/m$^2$, Fluorad® FC-431 at 0.054 g/m$^2$, and DC-510 at 0.054 g/m$^2$.

C. Compounding of Cyasorb® UV3638 with Polyester

A resin containing 5 wt-% of UV-absorber was prepared in the following manner. PET 7352 poly(ethylene terephthalate) resin (Eastman Chemical Co.) was dried in a Novatec Dryer for 6 hours at 157° C. The resin was compounded with UV3638 on the Welding Engineers Incorporated Twin Screw Compounding Machine. The UV3638 powder was fed by weight into the machine using a K-Tron Incorporated powder hopper feeding system. The K-Tron system allows one to feed the powder into the resin stream at a uniform 5% loading. The resultant material was a homogeneously blended mixture of PET 7352 and 5% UV3638, in pellet form, for future dilution in the extrusion process discussed below.

D. Extrusion of Polyester Sheets

A pelletized concentrate of 5% UV3638 and 95% PET 7352 was crystallized in a hot air oven in preparation for drying. The crystallization was done by placing trays full of the concentrate resin into the oven and then slowly raising the oven temperature from 93.3° C. to 149° C. over a period of several hours. Blends were made with the crystallize concentrate and crystallized PET 7352 to achieve loadings of 1% and 0.5% of the UV3638 light stabilizer. These blends were then dried in a desiccant dryer for 10 hrs. at 149° C. with a dew point of −3° C.

The dried resin was extruded using a 3.2 cm diameter screw, a 17.8 cm wide die, and a melt temperature of 277° C. The film was cast between the top and middle rollers of a 3-roll casting stack. The rollers were all 12.7 cm in diameter and temperature-controlled by internally circulated water. The roll temperatures were 43.3° C. for the top roller, 48.9° C. for the middle roller and 45.5° C. for the bottom roller. The extruder was run at 56 rev/min and the line speed was 3.57 m/min. The film produced was 15 cm wide and 313 μm thick. A control resin consisting of 100% PET 7352 (0% UV3638) was also dried and extruded at the same conditions.

The extruded films were then cut into 110 mm squares to be stretched on the Iwamoto film stretching apparatus. Each film sample was placed into the Iwamoto stretcher and all four sides were then gripped by small clamps to secure the sample for preheating, stretching and heatsetting. The samples were preheated for one minute with hot air at a temperature of 95° C. before being stretched simultaneously in each direction at a stretch rate of 100 mm/s. The final stretch ratio in each direction was 3.5:1. Each stretched sheet was then heatset to a film temperature of 118° C. for 1.5 minutes. The resulting sheets were about 25 μm thick with very good clarity and appearance. No yellow color was noted on visual inspection. The fade tests discussed below were each performed on three samples containing 0.0, 0.5, and 1.0 wt-% of UV3638, respectively (Sheets 1, 2, and 3).

E. Preparation of Adhesive Laminates

Bostik® Adhesive Laminate

Bostik® 7962 adhesive (Bostik Co.) was coated onto the polyester sheet samples prepared above at a level of 2.15 g/m$^2$ from a 3.19 wt-% solution of the adhesive in dichloromethane.

Phenoxy Adhesive Laminate

The Paphen® PKHJ phenoxy resin (Phenoxy Associates) was coated onto the polyester sheet samples prepared above at a level of 1.08 g/m$^2$ from a 5.00 wt-% solution of the resin in toluene/n-propanoycyclopentanone (65/30/5).

F. Printing of Thermal Images

Thermal Receiver A

The dye side of the donor element described above was placed in contact with the topmost layer of the receiver element. The assemblage was placed between a motor driven platen (35 mm in diameter) and a Kyocera KBE-57-12MGL2 thermal print head which was pressed against the slip layer side of the dye donor element with a force of 31.2 Newton.

The Kyocera print head has 672 independently addressable heaters with a resolution of 11.81 dots/mm of average resistance 1968 Ω. The imaging electronics were activated and the assemblage was drawn between the print head and the roller at 26.67 mm/s. Coincidentally, the resistance elements in the thermal print head were pulsed on for 87.5 μs every 91 μs. Printing maximum density required 32 pulses "on" time per printed line of 3.175 ms. The voltage supplied was 14.0 volt resulting in an energy of 4.4 J/cm$^2$ to print a maximum Status A density of 2.2 to 2.3. The image was printed with a 1:1 aspect ratio.

Thermal Receiver B

The imaged prints were prepared by placing the dye-donor element in contact with the polymeric receiving layer side of the receiver element. The assemblage was fastened to the top of the motor driven 53 mm diameter rubber roller and a TDK thermal head L-231, thermostated at 24° C. with a head load of 2 Kg pressed against the rubber roller. (The TDK L-231 thermal print head has 512 independently addressable heaters with a resolution of 5.4 dots/mm and an active printing width of 95 mm, of average heater resistance 512 Ω). The imaging electronics were activated and the assemblage was drawn between the printing head and roller at 20.6 mm/s. Coincidentally, the resistive elements in the thermal print head were pulsed on for 127 μs every 130 μs. Printing maximum density required 32 pulses "on" time per printed line of 4.6 ms. The images were printed with a 1:1 aspect ratio. The maximum printing energy was 5.1 J/cm$^2$.

G. Preparation of Samples for Light Fade Test

Example 1

Three samples of Receiver A containing the printed image were overlaid with a piece of Sheet 1, 2 and 3, respectively, without lamination. The samples were submitted for light fade (50 Klux, sunlight, 7 day) after the initial Status A densities were recorded. After 7 days, the samples were removed from the light source, the overlays removed, and the final Status A density values determined. The degree of light fade is shown in the Table below as a decrease in density where a higher value indicates a higher degree of fade.

Example 2

Sheets 1, 2 and 3 were coated with a layer of phenoxy adhesive as described above. Three printed samples of Receiver A were laminated with the sheet samples at 350° C. using a Kodak Readyprint® Photo Laminator. The samples were submitted for light fade and analyzed using the same procedure as Example 1.

Example 3

Samples were prepared as in Example 1, except that Receiver B was used to print the images.

Example 4

Sheets 1,2 and 3 were coated with a layer of Bostik® 7962 adhesive as described above. The samples were laminated with Receiver B and submitted for light fade under conditions used in Example 3.

Example 5

Samples were prepared, laminated and tested as in Example 4 except that the adhesive used to coat the polyester sheets was phenoxy resin Paphen® PKHJ. The following results were obtained:

TABLE

| Test Receiver | Adhesive | UV-absorber Content | % Status A Density Loss | | |
|---|---|---|---|---|---|
| Designation | Laminate | (wt-%) | Cyan | Magenta | Yellow |
| Receiver A | none | 0 | 50 | 29 | 81 |
| (Example 1) | | 0.5 | 17 | 16 | 57 |
| | | 1.0 | 16 | 12 | 30 |
| Receiver A | phenoxy | 0 | 75 | 18 | 66 |
| (Example 2) | resin | 0.5 | 42 | 10 | 42 |
| | | 1.0 | 51 | 10 | 44 |
| Receiver B | none | 0 | 8 | 15 | 18 |
| (Example 3) | | 0.5 | 4 | 7 | 1 |
| | | 1.0 | 4 | 9 | 1 |
| Receiver B | Bostik ® | 0 | 22 | 18 | 23 |
| (Example 4) | 7962 | 0.5 | 11 | 12 | 10 |
| | | 1.0 | 9 | 12 | 8 |
| Receiver B | phenoxy | 0 | 28 | 17 | 12 |
| (Example 5) | resin | 0.5 | 21 | 13 | 11 |
| | | 1.0 | 18 | 13 | 9 |

The above results show that the samples containing either 0.5 or 1.0 wt-% UV3638 have less light fade for cyan, magenta and yellow dyes than the control with no UV3638.

The invention has been described in detail with particular reference to preferred embodiments thereof, but it will be understood that variations and modifications can be effected within the spirit and scope of the invention.

What is claimed is:

1. A dye-receiver element comprising a support having thereon a dye-receiving layer containing a thermally-transferred dye image, said dye-receiving layer having on top thereof a transparent protective sheet comprising a polyester resin containing a benzoxazinone ultraviolet absorbing agent.

2. The element of claim 1 wherein said transparent protective sheet is laminated to said receiving element by means of an adhesive.

3. The element of claim 2 wherein said adhesive comprises a phenoxy resin.

4. The element of claim 3 wherein said phenoxy resin comprises

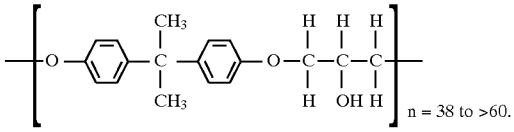

5. The element of claim 1 wherein said adhesive is a polyester ionomer.

6. The element of claim 1 wherein said polyester sheet is biaxially-oriented.

7. The element of claim 1 wherein said ultraviolet-absorbing agent is present at a concentration of from about 0.01 to about 5.0 wt-%.

8. A process of laminating a transparent protective sheet on top of a thermal dye transfer image comprising:

(I) imagewise-heating a dye-donor element comprising a support having thereon a dye layer comprising a benzoxazinone image dye in a binder, said dye-donor being in contact with a dye-receiving element, thereby transferring a dye image to said dye-receiving element to form said dye transfer image; and (II) thermally laminating said transparent protective sheet on top of said transferred dye image by means of an adhesive;

said transparent protective sheet comprising a biaxially-oriented polyester resin containing an ultraviolet absorbing agent.

9. The process of claim 8 wherein said transparent protective sheet is laminated to said receiving element by means of an adhesive.

10. The process of claim 8 wherein said adhesive comprises a phenoxy resin.

11. The process of claim 10 wherein said phenoxy resin comprises

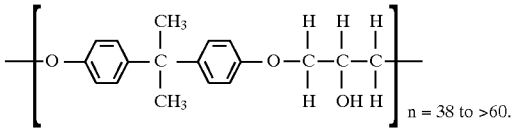

12. The process of claim 8 wherein said adhesive is a polyester ionomer.

13. The process of claim 8 wherein said polyester sheet is biaxially-oriented.

14. The process of claim 8 wherein said ultraviolet-absorbing agent is present at a concentration of from about 0.01 to about 5.0 wt-%.

* * * * *